United States Patent [19]

Kramer

[11] 4,365,722

[45] Dec. 28, 1982

[54] REMINDER CLOSURE

[76] Inventor: Steven G. Kramer, 60 El Verano Way, San Francisco, Calif. 94127

[21] Appl. No.: 277,985

[22] Filed: Jun. 26, 1981

[51] Int. Cl.[3] ..... B65D 55/02

[52] U.S. Cl. ..... 215/220; 206/534

[58] Field of Search ..... 215/219, 220, 230, 304; 206/534, 459; 222/153

[56] References Cited

U.S. PATENT DOCUMENTS

| | | | |
|---|---|---|---|
| 4,011,829 | 3/1977 | Wachsmann et al. | 206/534 X |
| 4,069,935 | 1/1978 | Hampel | 215/220 X |
| 4,069,942 | 1/1978 | Marshall et al. | 206/534 X |
| 4,220,247 | 9/1980 | Kramer | 215/219 |

*Primary Examiner*—George T. Hall

*Attorney, Agent, or Firm*—Emrich, Lee, Brown & Hill

[57] ABSTRACT

A container closure comprises an inner housing having means for sealably mounting to a container. A plurality of indicia are removably disposed in a relatively fixed stationary manner upon the inner housing. An outer housing is rotatably mounted to the inner housing and includes an aperture extending therethrough aligned with the indicia of the inner housing effective to pass the indicia past the aperture for viewing. One of the housings has a plurality of depressed grooves positioned upon its cylindrical walls. At least one rib on the other housing is engageable with at least one of the depressed grooves during the rotation of the outer housing and is restrained in a manner effective to stop the relative rotation of the housings in one direction, yet yieldingly resist rotation of the housings relative to each other in the opposite direction. The indicia are disposed on the inner housing such that predetermined indicia are visible through the aperture when at least one rib is engaged with at least one depressed groove.

23 Claims, 26 Drawing Figures

DAILY
NUMERICAL
4 TIMES
TWICE
DAILY
Q2H
QID

REMINDER FUNCTION

REMINDER FUNCTION

CHILD-PROOF FUNCTION

CHILD-PROOF FUNCTION

REMINDER CLOSURE

BACKGROUND OF THE INVENTION

The present invention relates to closure members for containers, bottles and the like, and, more particularly, to closure members which are particularly well adapted for use on dispensing containers for medicinal agents.

Present medical drugs have a predetermined therapeutic range in which the effects of taking the drug are beneficial. Under-utilization of a drug may endanger the user with the drug's side effects without reaching levels necessary for a therapeutic action. On the other hand, over-utilization may cause side effects or toxicity to a much greater extent than any possible benefit. Thus, it is critically important that a patient follow prescribed directions on medications; yet, frequently patients forget whether they have taken medication and either omit doses or repeat them.

This problem is particularly severe for elderly patients who are generally beset with multiple ailments requiring numerous drugs and directions. The fading memory and confusion that come with age further compound the problem. Oftentimes, elderly patients could well lead independent self-sufficient lives but for their inability to follow a therapeutic regimen necessary to their health and well-being. Caps of the "reminder" type will be an important adjunct in drug therapy as the number of elderly people increases and new potent drugs are utilized.

The reminder cap of the present invention affords improvements over closure members of the type known in the art. Such closure members are shown in U.S. Pat. No. 2,664,452, issued July 7, 1953 to F. E. Brown; U.S. Pat. No. 2,767,680, issued Oct. 23, 1956 to H. B. Lermer; U.S. Pat. No. 3,072,276, issued Jan., 1963 to Nichols, U.S. Pat. No. 3,151,599, issued Oct. 6, 1964 to R. J. Livingston; U.S. Pat. No. 3,960,713, issued June 1, 1976 to H. L. Carey; U.S. Pat. No. 4,011,829, issued Mar. 15, 1977 to D. B. Wachsmann et al.; and my own U.S. Pat. No. 4,220,247 issued Sept. 2, 1980.

SUMMARY OF THE INVENTION

One embodiment of the present invention includes a closure member having an inner housing. The inner housing has means for sealably mounting to a container and, also, a plurality of indicia removably affixed in a relatively stationary manner thereupon. The closure further includes an outer housing rotatably mounted to the inner housing and having an aperture extending therethrough aligned with the indicia in a manner effective to pass the indicia past the aperture for viewing purposes when the inner and outer housings are rotated relative to each other. The inner and outer housings include abutment means therebetween in position to mutually engage during the relative rotation of the inner and outer housings. The abutment means are effective to stop the relative rotation of the inner and outer housings in one direction and yieldingly resist the relative rotation of the inner and outer housings in the opposite direction. The indicia are further disposed on the inner housing in a spaced manner corresponding to the spacings of the abutment members such that at least one of the indicia marks is visible through the aperture when the abutment means are engaged.

A preferred embodiment of the present invention includes a plurality of indicia disposed upon an insertable disc removably mounted in a relatively stationary manner on the inner housing.

Alternatively, indicia may be disposed upon an insertable indicia cylinder removably mounted in a relatively stationary manner to the vertical cylindrical walls of the inner housing. The insertable indicia disc or cylinder may be held stationary by adhesive means, interlocking or keyed holes and protrusions, tongue and grooves or other similar means. The indicia may also be simply disposed upon paper or other thin material to be wrapped around or adhered to the inner housing by adhesive.

The present invention can be readily adapted for use with dispensing containers of different sizes and shapes. The removable inner and outer housings and the indicia member can be modified to resemble the shape of the container opening to be sealed. The present invention also has application to ophthalmic drop dispensing bottles wherein the pointed projecting drop dispensing tips of the bottles make the use of closure members having substantially conical portions advantageous. For these applications, the present invention affords a removable conical indicia member and an outer housing having an open top allowing the inner housing to project therethrough.

A further embodiment of the present invention includes closure members having multiple openings disclosing different predetermined types of indicia. Each opening may represent a different dose schedule. Unwanted regimens may be covered by opaque tape. Such an embodiment permits the present invention to have a wide range of applications.

The present invention affords a reminder cap closure member which may be latched to a container on which it is mounted to render it difficult for a young child to open while providing a closure member that can be readily opened and closed by the average adult.

Other features and advantages of the present invention will be apparent from the following description and claims and are illustrated in the accompanying drawings which, by way of illustration, show preferred embodiments of the present invention and the principles thereof and what are now considered to be the best mode to apply these principles. Other embodiments of the invention embodying the same or equivalent principles may be used and structural changes may be made as desired by those skilled in the art without departing from the present invention and the purview of the appended claims.

DESCRIPTION OF THE DRAWINGS

FIG. 1 is a side elevational view of a closure member in accordance with one embodiment of the present invention showing the closure member mounted on a container in closing relation thereto;

FIG. 2 is a fragmentary side view of a closure member in accordance with the present invention which when mounted on a container in a closing relation thereto is difficult for a young child to operate and open;

FIG. 3 is an exploded, side sectional view of the inner housing and indicia disc of the embodiment of the present invention illustrated in FIGS. 1 and 2;

FIG. 4 is a fragmentary plan view taken substantially along the line 4—4 in FIG. 2;

FIG. 5 is a plan view of a modified insertable disc in accordance with the present invention having an elongated slot therein for mounting;

FIG. 6 is a fragmentary side view of a closure member in accordance with another embodiment of the present invention which is difficult for a young child to operate and open;

FIG. 7 is a fragmentary view of a container on which the embodiment of the closure member illustrated in FIG. 6 is adapted to be mounted on;

FIG. 8 is a side view of a closure member in accordance with a further embodiment of the present invention showing the closure member mounted on a container in closing relation thereto;

FIG. 9 is an exploded, side sectional view of the embodiment of the present invention illustrated in FIG. 8;

FIG. 10 is a sectional plan view of the embodiment of the present invention illustrated in FIG. 8 taken substantially along the line 10—10 of FIG. 9;

FIG. 11 is a side elevational view of still another closure member in accordance with the present invention;

FIG. 12 is a side elevational view of the inner housing of the closure member illustrated in FIG. 11;

FIG. 13 is a top plan view of the insertable disc arrangement of the closure member illustrated in FIGS. 11 and 12 in accordance with the present invention;

DETAILED DESCRIPTION

Figures 1, 2, 3, 4, 5, 6, 7, 8, 9, 10, 11, 12, 13:
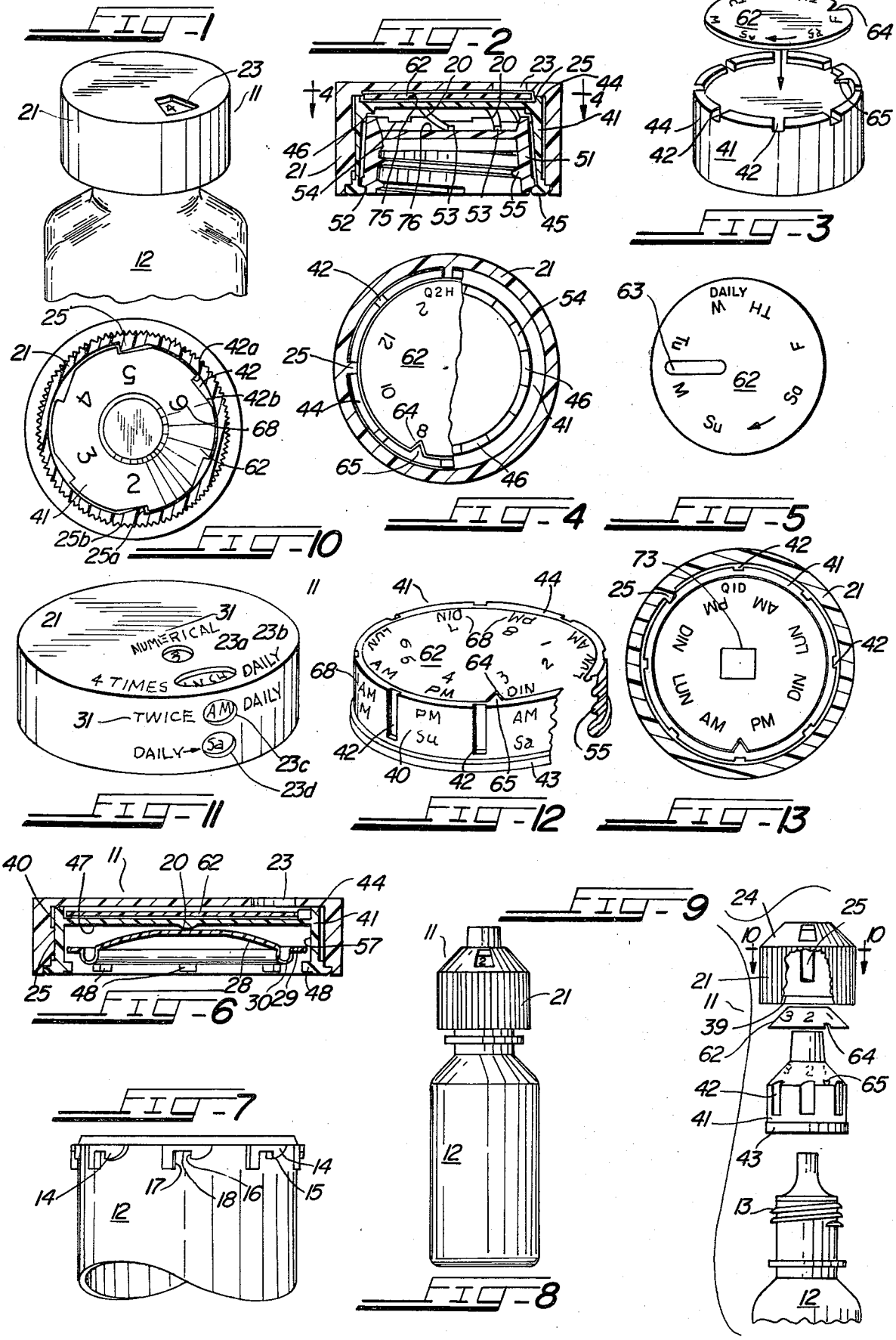

A closure member embodying the principles of the present invention, generally designated by numeral 11, as best seen in FIG. 1, is mounted on a container 12 in closing relation thereto. As shown in FIGS. 2–4, the closure member 11 is comprised of the following major elements; an outer housing 21 having an aperture 23 and abutment means 25 positioned inwardly of the inside corner thereof, an inner housing 41 having a projecting rim 44 thereon and groove means 42 therein, inner cap member 51 for securing the closure member 11 to the container 12, and removable indicia 62 adapted to be affixed in a relatively stationary manner to the inner housing 41.

The closure member 11 may have any cross-sectional shape; however, a number of factors may influence the shape used. Closure members 11 having a cylindrical shape are well adapted for use on bottles and vials having threaded openings, as shown in FIG. 1. The cylindrical shape allows for the positioning of an aperture or apertures 23 upon the top planar surface of the outer housing 21 or about the vertical cylindrical wall, as shown in FIG. 11.

In the closure member 11, as depicted in FIGS. 1–4 the removable indicia member is comprised of a disc 62 secured to the inner housing 41 by suitable means, such as an adhesive. As illustrated in FIGS. 3 and 4, the disc 62 is held relatively stationary on the inner housing 41 by a locking indentation 64 about the circumference of the disc 62, which cooperates with a protrusion 65 about the projecting rim 44 of the inner housing 41. Additionally, FIG. 5 illustrates a disc 62 having an elongated slot 63 therein which would fit upon a complimentary protrusion (not shown) on the upper surface 75 of the inner housing 41 to affix the disc 62 in a relatively stationary manner to the inner housing. FIG. 13 illustrates a disc 62 having a square-keyed opening 73 therein (shown in dotted lines) in its center which would fit upon a complimentary protrusion (not shown) extending from the upper surface 75 of the inner housing 41 to affix the disc 62 in a relatively stationary manner to the inner housing, in accordance with the present invention.

In FIGS. 2 and 3, the inner housing 41 includes an upwardly projecting rim 44 which provides a circular space between the inner housing 41 and the outer housing 21 sufficient to provide space for the disc 62 to prevent the disc 62 from interfering with the relative rotation of the inner and outer housings 41 and 21, respectively.

The closure member 11 of the present invention is equipped with threads or other latching means 55 for securing to a container or bottle 12. Referring to FIG. 2, the closure member 11 is mounted over an inner cap member 51 equipped with means for latching and securing to the container 12, such as threads 55. The inner cap member 51 is nested within the inner housing 41 of the closure member 11 and secured by a flange 45 extending around the bottom portion of the inner housing 41 and snugly fitting into an indentation 52 on the inner cap member.

A plurality of spring fingers or elements 20 extend downwardly and rests upon the top planar surface 76 of the inner cap member 51. Projection means 53 extend upwardly from the top planar surface 76 of the inner cap member 51 and permit the spring fingers 20 to slideably deflect upwardly over the projection means 53 in one rotational direction, and prevent the spring fingers 20 from rotatably moving past the projection means 53 in the opposite direction when the spring fingers 20 and the projection means 53 become engaged.

Downwardly projecting teeth 46 extend from the inner housing 41 and upwardly projecting grooves 54 extend from the inner cap member 51 in a complimentary spaced manner. The teeth 46 and grooves 54 are prevented from meshing with each other by the upward force exerted upon the inner housing 41 by the spring fingers 20 engaging the top planar surface 76 of the inner cap member. Downward forces upon the outer housing 21 are transferred to the inner hosuing 41 by engagement of abutment means 25 with the grooves 42 in the upwardly-projecting rim 44 on the inner housing. This engagement compresses the spring fingers 20 and narrows the space between the inner cap member 51 and the inner housing 41 thereby resulting in the engagement of teeth 46 of the inner housing and grooves 54 of the inner cap member. When the teeth 46 and grooves 54 are so engaged, and the abutment means 25 and grooves 42 of the inner and outer housing 41 and 21 are similarly engaged, the inner cap member can be rotated in unison with the inner and outer housings in the direction in which the spring fingers 20 would otherwise slideably deflect over the projection means 53. When the force upon the outer housing 21 is released, the spring fingers 20 again force the inner housing 41 upward, disengaging the teeth 46 from grooves 54. In this position, rotation of the outer housing 21 and the inner housing 41 is ineffective in rotating the inner cap member 51 in the untightening direction, unless the cap member has already been loosened because of prior engagement of the teeth 46 with the grooves 54. This construction is highly effective in preventing the accidental opening of a container by a young child.

Another embodiment of the present invention is illustrated in FIGS. 6 and 7. The container 12 in FIG. 7 includes locking ribs 14 projecting outwardly about the upper/outer portions of the rim of the container 12. Each locking rib 14 includes a curved area 15 extending downwardly from the top of the locking rib 14 to a locking channel 18 extending upward perpendicularly to the rim of the container 12. The forward wall of the channel 18 affords a forward stop 16. The rear wall of the locking channel 18 affords a rear stop 17 projecting downwardly parallel to the forward stop 16 and below the curved area 15.

Referring now to FIG. 7, the inner housing 41 of the closure member 11 has lugs 48 projecting inwardly around the lower rim of the inner housing 41 in a spaced manner corresponding to the spacings of the locking ribs 14 of the container 12 of FIG. 7. A circular resilient seal 28 has a flange 29 extending radially outward around the circumference beyond the inwardly projecting lug to retain the seal 28 within the cavity formed by the cylindrical wall 57 and horizontal wall 47 of the inner housing 41. A rim 30 extends downwardly from the flange 29 for nesting securely against the cylindrical inner wall of the container 12 illustrated in FIG. 7. The circular resilient seal 28 projects upwardly to rest against projection 20 extending downwardly from the bottom surface of the horizontal wall 47 of the inner housing 41. The container 12, illustrated in FIG. 7, can be forced upwardly into the cavity within the inner housing 41 such that the rim of the container 12 rests against the flange 29. As the flange 29 is forced upward by the container 12, the center area of the seal 28 forces the seal rim 30 against the inner walls of the container 12. As the inner housing is rotated in a clockwise direction, the lugs slide downwardly over the curved area of the locking rib 14 and into the locking channel 18. The forward and rear stops 16 and 17 will prevent further movement of the lugs 48 of the inner housing 41 and will secure the closure member upon the container when the closure member 11 and the container 12 are no longer compressing. The lugs 48 are retained in the locking channel 18 by the upward force exerted on the inner housing 41 by the compressed seal 28 engaging projection 20.

A removable indicia member in the form of a disc 62 is disposed upon the upper planar surface of the inner housing 41. A circular space is provided between the outer housing 21 and the inner housing 41 by a vertically projecting portion 44 which prevents the binding of the indicia member 62 when a downward force is exerted upon the outer housing 21 during an opening or closing operation. An abutment rib 25 extends inwardly from the inner cylindrical wall of the outer housing 21 to engage with abutment grooves (not shown) disposed upon the outer cylindrical wall 40 of the inner housing 41, as illustrated by the abutment grooves 42 in FIG. 12. However, it should be noted that it is within the scope of the present invention that the inner housing 41 may include a projection portion 44 with grooves 42 therein (as shown in FIG. 3), which cooperate with abutment means 25 extending inwardly and downwardly from the inside of the outer housing 21 (as shown in FIG. 2). An aperture 23 is provided in the top surface of the outer housing 21 for viewing the indicia disposed upon the disc 62. As the closure member 11 is pushed down and turned counter clockwise to open, the abutment means of the inner and outer housings 21 and 41 engage to allow rotation of both housings in unison. In closing, the abutment means are yieldingly engaged to allow the housings 21 and 41 to rotate in unison until the lugs 48 reach rear stop 17. Further rotation of the outer housing 21 causes the abutment means 25 thereon to yield permitting the outer housing 21 to rotate relative to the inner housing 21 and to reveal a new indicia in the aperture 23. It will be seen that this construction of the present invention is also highly effective in preventing a young child from accidentally opening the closure while still providing a novel closure member having reminder features therein.

As shown in FIGS. 8–10, another embodiment of the present invention has particular application to ophthalmic drop dispensing bottles wherein the pointed projecting tip portion of the bottles make the use of closure members having conical proportions advantageous. Referring now to the exploded side view of the closure member 11 as shown in FIG. 9, the closure member 11 includes an outer housing 21 and an inner housing 41 having an open bottom equipped with threads (not shown) for sealably mounting the closure member onto threads 13 conveniently positioned near the top of the container 12, as is known in the art. An indicia disc or means 62, conforming to the dimensions of the inner housing 41, is removably mounted thereto and secured by either adhesive means (not shown) or by aligning the disc 62, having a cut-out recess 64 therein, with a projection 65 extending upwardly from the inner housing 41. Such alignment secures the indicia disc to the inner housing 41. However, it is within the scope of the embodiments described in this specification, that a plurality of indicia 68 best shown in FIG. 12, may be disposed upon the upper surfaces of the inner housing 41 in a spaced manner. As shown in FIG. 9, an outwardly projecting ridge 43 exxtends around the lower base of the inner housing 41. The outer housing 21 is rotatably mounted to the inner housing 41 and is secured in place by a retaining groove 39 extending around the base of the inner wall of the outer housing 21 for receiving the outwardly projecting ridge 43 of the inner housing 41.

Abutment means 25 are disposed upon the vertical cylindrical wall of the inner housing 41. Referring now to FIG. 10, the abutment means of the inner housing 41 includes triangular grooves 42 having one wall 42*a* which is substantially perpendicular to the circumference of the housing and a second inclined wall 42*b*. Abutment means are also disposed on the vertical cylindrical wall of the outer housing 21. The abutment means includes a wedge-shaped rib 25 projecting inwardly from the inner cylindrical wall of the outer housing 21. As can best be seen in FIG. 10, the wedge-shaped rib 25 has one face 25*a* substantially perpendicular to the circumference of the housing and an inclined face 25*b* extending from the housing compliments the shape of the abutment means disposed on the inner housing 41. The abutment means on the inner and outer housings, 21 and 41, are positioned to mutually engage during the relative rotation of the inner and outer housings, in a manner effective to stop the relative rotation of the inner and outer housings in one direction an yieldingly resist the relative rotation of the inner and outer housing in the opposite direction.

An aperture 23 extends through the conical portion 24 of the outer housing 21. Indicia 68 are disposed on the indicia disc or means 62 in a spaced manner corresponding to the spacings of the abutment members such that at least one of the indicia is visible through the aperture when the abutment members are engaged. When the closure member 11 is rotatably mounted to the container 12, the wedge-shaped rib 25 on the outer housing 21 engages a predetermined triangular groove 42 in the inner housing 41 to indicate the desired indicia and that the closure member 11 is secured to the container 12.

A further embodiment of the present invention is illustrated in FIGS. 11–13. The closure member 11 illustrated in FIG. 11 has a similar construction to that already described previously but for the plurality of apertures 23*a*, 23*b* disposed upon the top of the outer housing and apertures 23*c* and 23*d* disposed along the cylindrical wall of the outer housing 21. Explanatory indicia 31 are disposed upon the surface of the outer housing 21 about the apertures 23*a* through 23*d*. The different indicia disposed upon the outer housing and their respective apertures represent different regimens or schedules. At the time of dispensing, unwanted schedules or regimens may be blocked out by masking the indicia 31 and apertures 23 with opaque tape or the like.

Referring now to FIG. 12, the inner housing 41 of the closure member 11 is shown having a removable indicia member in the form of a disc 62 disposed upon the upper surface of the inner housing 41. An upwardly projecting rim 44 prevents the rotation of the inner and outer housings 21 and 41 from binding the disc 62. Abutment means in the form of depressed grooves 42 are disposed in a spaced vertical manner along the cylindrical wall of the inner housing 41 for engaging abutment means or a wedge-shaped rib, shown as 25 in FIG. 13, on the inner surfaces of the cylindrical wall of the outer housing 21. A plurality of indicia members 68 are disposed upon the surfaces of the cylindrical wall 40 of the inner housing 41. An outwardly projecting ridge 43 extends around the bottom of the cylindrical wall of the inner housing 41 to engage the bottom portion 22 of the outer housing 21 to rotatably secure the inner housing 41 within the outer housing 21 and to permit the indexing of the indicia past the apertures 23*a* and 23*d*, as desired, when the member 11 has been threaded onto a closure (not shown) by threads 55. Again, it should be pointed out that it is within the scope of the present embodiment that the inner housing 41 and the projecting rim 44 may include grooves on the top thereof which cooperate with abutment means 25 extending inwardly and downwardly from the outer housing, as shown in FIGS. 2 and 3.

Figure 14:
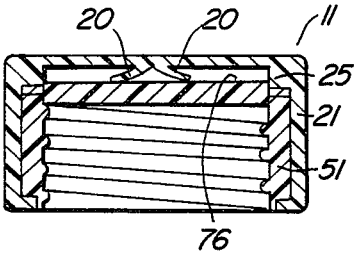
FIG. 14 is an exploded, side sectional view of a closure member in accordance with another embodiment of the present invention which is difficult for a young child to operate and open.
Figure 17:
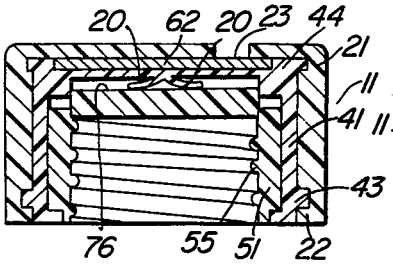
FIG. 17 is an exploded, side sectional view of a closure member in accordance with another embodiment of the present invention which is difficult for a young child to operate and open.
Figure 21:
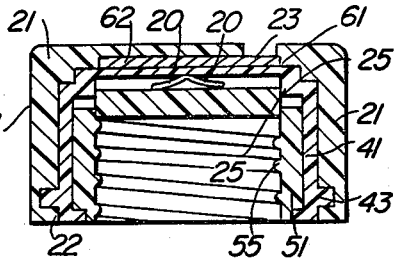
FIG. 21 is an exploded, side sectional view of a closure member in accordance with another embodiment of the present invention which is difficult for a young child to operate and open.
Figure 15:
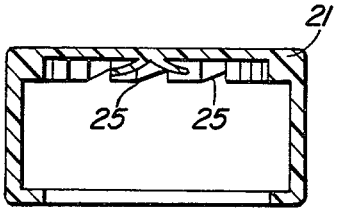
FIG. 15 is an exploded, side sectional view of the outer housing of the embodiment of the present invention illustrated in FIG. 14.
Figure 18:
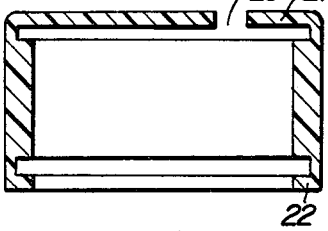
FIG. 18 is an exploded, side sectional view of the outer housing of the embodiment of the present invention illustrated in FIG. 17.
Figure 16:
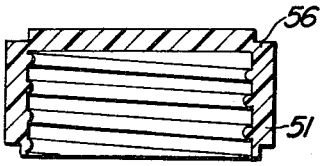
FIG. 16 is an exploded, side sectional view of the inner housing of the embodiment of the present invention illustrated in FIG. 14.
Figure 19:
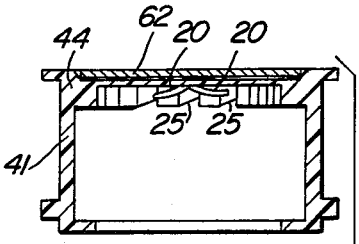
FIG. 19 is an exploded, side sectional view of the inner housing and indicia disc of the embodiment of the present invention illustrated in FIG. 17.
Figure 25:
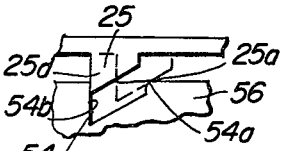
FIG. 25 is a fragmentary view of the abutment means and grooves of the closure member of FIGS. 14–24 in the outward at rest position in accordance with the present invention.
Figure 26:
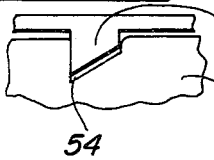
FIG. 26 is a fragmentary view of the abutment means and grooves of the closure member of FIGS. 14–24 in the inward untightening position in accordance with the present invention.
Figure 20:
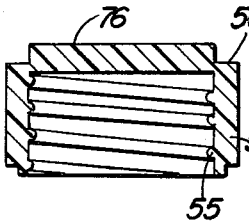
FIG. 20 is an exploded, side sectional view of the inner cap member of the embodiment of the present invention illustrated in FIG. 17.
Figure 24:
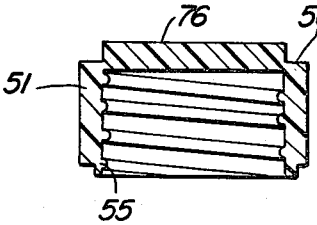
FIG. 24 is an exploded, side sectional view of the inner cap member of the embodiment of the present invention illustrated in FIG. 21.

A further embodiment of the present invention is illustrated in FIGS. 14–16 wherein the closure member 11 is comprised of an outer housing 21 and an inner cap member 51. A plurality of spring fingers 20 extend downwardly from the inside of the outer housing 21 and engage the top planar surface 76 of the inner cap member 51 and abutment means 25 extend downwardly from the inside corner of the outer cap housing and are engageable with complimentary grooves 54 located in the rim 56 of the inner cap member 51. As shown in FIGS. 25 and 26, the abutment means 25 are preferably trapezoidal shaped and the complimentary grooves 54 are of a corresponding configuration. And, it is within the scope of the present invention that the inner cap member 51 may include a projecting rim 44, as depicted in FIGS. 2–4.

The abutment means 25 and grooves 54 are only partially meshed with each other when the outer housing 21 is in the outward at rest position because of the outward force exerted upon the outer housing 21 by the spring fingers 20 engaging the top planar surface 76 of the cap member 51. Importantly, the abutment means 25 and grooves 54 of the outer housing and inner cap member, respectively, are partially engaged at all times and the inner cap can be rotated in unison with the outer housing in the direction in which the inner cap is tightened upon the container. A downward force upon the outer housing 21 is transferred to the inner cap member 51 by compressing the spring fingers 20 and narrowing the space between the inner cap member 51 and outer housing 21 thereby fully engaging the abutment means 25 of the outer housing and grooves 54 of the inner cap member, a position as shown in FIG. 26. When the force upon the outer housing 21 is released, the spring fingers 20 again force the outer housing 21 upward, partially disengaging the abutment means 25 from grooves 54, the position as shown in FIG. 25. In this relaxed position, rotation of the outer housing 21 with respect to the inner housing 41 is effective in tightening the inner cap member 51 onto the closure. This results because the projection end 25*d* is engaged with groove side 54*b*, as shown in FIG. 25. However, if it is desired to unscrew the closure member 11 from the container, when the cap member is in a fully tight condition, the rotation of the outer housing 21 in the untightening direction results in the abutment means 25 deflecting past the groove 54 such that such rotation of the outer housing is ineffective in removing the inner cap member 51 from the closure.

Thus, the closure member will close to a full tight condition about the closure but will not open from full tight unless the outer housing is downwardly forced against the inner cap member to fully engage the abutment means 25 with the grooves 54, a position as shown in FIG. 26. When the inner cap member has been loosened from the container, the partial engagement of the abutment means 25 with the grooves 54 when the outer housing is in the relaxed position, is sufficient to rotate the inner cap member and remove the same from the closure. This results because the corner 54*a* of the groove 54 (FIG. 26) is rounded to permit partial engagement with the end surface 25*a* of the abutment means 25 (FIG. 25) to permit the outer housing 21 to rotate the inner cap member when the inner cap member is in the untight condition about the container. Such a construction is highly effective in preventing the accidental opening of the container by a young child and provides the unique child-proof function in accordance with the present invention.

Still a further embodiment of the present invention is illustrated in FIGS. 17–20 wherein the closure member 11 is comprised of an outer housing 21, an inner housing 41 and an inner cap member 51. The inner housing 41 is shown having a removable indicia member in the form of a disc 62 disposed upon the upper surface of the inner housing 41. An upwardly projecting rim 44 prevents the rotation of the inner and outer housings 21 and 41 from binding the disc 62. Although not shown, the disc 62 includes an opening 64 therein which cooperates with a projection 65 to prevent movement of the disc with respect to the outer housing 21. Although not shown in the drawings, abutment means in the form of depressed grooves 42 are disposed and spaced in a vertical manner along the cylindrical wall of the inner housing 41 for engaging a wedge-shaped abutment means, similar to element 25 in FIG. 13, on the inner surfaces of the cylindrical wall of the outer housing 21. Additionally, the outer housing 21 includes an opening 23 therein which cooperates with the indicia disc 62 to reveal indicia thereon. When the inner housing 41 is nested within the outer housing 21, an outwardly projecting ridge 43 extends around the bottom of the cylindrical wall of the inner housing 41 to engage the bottom portion 22 of the outer housing 21 to rotatably secure the inner housing within the outer housing and to facilitate indexing of the indicia past the aperture 23 when the closure member 11 is threaded onto a closure (not shown) by threads 55.

A plurality of spring fingers 20 extend downwardly from the inside of the inner housing 41 and rest upon the top planar surface 76 of the inner cap member 51. Abutment means 25 (FIG. 19) extend downwardly from the inside corner of the inner housing and are engageable with complimentary grooves 54 (FIG. 26) located in the rim 56 of the inner cap member 51, in the same manner as pointed out in the discussion with respect to FIGS. 14–16. Preferably, the abutment means 25 and grooves 54 are of a trapezoidal shaped configuration, as shown in FIGS. 25 and 26. The downwardly projecting abutment means 25 and the grooves 54 are positioned in a complimentary spaced manner, such that the abutment means 25 and grooves 54 only partially mesh together with each other when the outer housing is in an outward relaxed position. In this relaxed position, rotation of the outer housing 21 and inner housing 41 is ineffective to rotate the inner cap member 51 when the inner cap member is in the tight position. A downward force upon the outer housing 21 pushes downwardly the inner housing 41 and compresses the spring fingers 20 and narrows the space between the inner housing 41 and the inner cap member 51 thereby engaging the abutment means 25 of the inner housing with the grooves 54 of the inner cap member. When the abutment means 25 and grooves 54 of the inner housing and the inner cap member are so engaged, the inner cap member may be rotated in unison with the outer housing. When the force upon the outer housing is released, the spring fingers 20 again force the inner housing 41 upward partially disengaging the abutment means 25 from the grooves 54. In this relaxed position, rotation of the outer housing 21 with respect to the inner housing 41 is ineffective to rotate the inner cap member 51, unless the inner cap member is loosely affixed to the closure, as previously described with respect to the embodiment shown in FIGS. 14–16. Also, as previously pointed out with respect to FIGS. 14–16, the combination of elements shown in FIGS. 18 and 19 describe a structure which provides for the reminder function of the closure member 11, and FIGS. 19 and 20, together with the abutment means 25 and the grooves 54, describe a structure which provides the child-proof function for the closure member 11.

Still another embodiment of the present invention is illustrated in FIGS. 21–24 wherein the closure member 11 is comprised of an outer housing 21, an inner housing 41 and an inner cap member 51. The outer housing 21 includes a recess 59 therein which is adapted to receive a removable indicia member in the form of a disc 62. A shoulder 61 on the inner housing 41 prevents the rotation of the inner and outer housings 21 and 41 from binding the disc 62. Although not shown, the disc 62 includes an opening 64 therein which cooperates with projection 65 to prevent movement of the disc with respect to the outer housing 21. The outer housing 21 includes an opening 23 therein which cooperates with the indicia disc 62 to reveal indicia thereon. When the inner housing 41 is nested within the outer housing 21, an outwardly projecting ridge 43 extends around the bottom of the cylindrical wall of the inner housing 41 to engage the bottom portion 22 of the outer housing 21 to rotatably secure the inner housing within the outer housing and to facilitate indexing of the indicia past the aperture 23 when the closure member 11 is threaded onto a closure (not shown), by threads 55.

Figure 22:
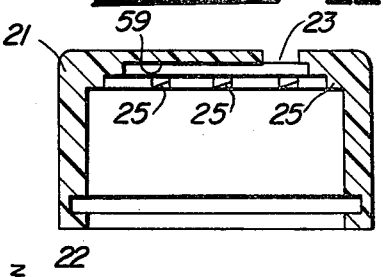
FIG. 22 is an exploded, side sectional view of the outer housing of the embodiment of the present invention illustrated in FIG. 21.
Figure 23:
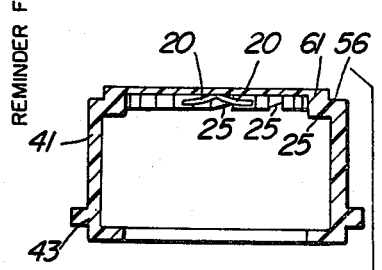
FIG. 23 is an exploded, side sectional view of the inner housing and indicia disc of the embodiment of the present invention illustrated in FIG. 21.

A plurality of spring fingers 20 extend downwardly from the inside of the inner housing 41 and rest upon the top planar surface 76 of the inner cap member 51. Abutment means 25 (FIG. 19) extend downwardly from the inside corner of both the outer and inner housings and are engageable with complimentary grooves 54 (FIG. 26) located in the rim 56 of both the inner housing 41 and the inner cap member 51, in the same manner as pointed out in the discussion with respect to FIGS. 14–16. The downwardly projecting abutment means 25 and the grooves 54 are positioned in a complimentary spaced manner, such that the abutment means 25 and grooves 54 only partially mesh with each other when the outer housing is in an outward relaxed position. In this relaxed position, rotation of the outer housing 21 and inner housing 41 is ineffective to untighten the inner cap member 51 when the inner cap member is in the tight position, as previously described with respect to FIGS. 14–16. A downward force upon the outer housing 21 pushes downwardly the inner housing 41 and compresses the spring fingers 20 and narrows the space between the inner housing 41 and the inner cap member 51 thereby engaging the abutment means 25 of the inner housing with the grooves 54 of the inner cap member, a position as shown in FIG. 26. When the abutment means 25 and grooves 54 of the outer housing, the inner housing and the inner cap member are so engaged, the inner cap member may be untightened and rotated in unison with the outer housings. When the force upon the outer housing is released, the spring fingers 20 again force the inner housing 41 upward partially disengaging the abutment means 25 from the grooves 54. In this relaxed position, further rotation of the outer housing 21 with respect to the inner housing 41 is effective in rotating the inner cap member 51 because the inner cap member is loosely affixed to the closure. As previously pointed out with respect to FIGS. 14–16, the elements shown in combination with respect to FIGS. 22 and 23 illustrate a structure which provides for the reminder function of the closure member 11 and the elements shown in FIGS. 23 and 24, together with the abutment means 25 and the grooves 54, provide the child-proof function for the closure member 11. Preferably, the abutment means 25 and grooves 54 are of a trapezoidal shape configuration, as shown in FIGS. 25 and 26, which provide the unique child-proof function of the closure member 11.

As is well understood from the above disclosure, the closure member 11 includes an inner housing 41 having abutment members thereon comprised of grooves in either the projecting rim 44 of the inner housing or positioned substantially lengthwise upon the outer horizontal wall surface thereof. These grooves, although shown in FIG. 3 to be substantially perpendicular recessed openings may be of a depressed ramp configuration, as shown in FIGS. 9 and 10, or of a trapezoidal shape configuration, as shown in FIGS. 25 and 26. Additionally, the abutment means 25 preferably includes a projection or projections extending either inwardly from the inner cylindrical wall of the outer housing 21 or inwardly and downwardly from the upper wall or corner of the outer housing 21 which engage the grooves 42 in the rim 44, a castle-like structure, or grooves in the side-wall to permit the outer housing to rotate relative to the inner housing to reveal indicia in the aperture 23 of the outer housing 21.

Also, the unique closure member in accordance with the present invention may be constructed to either include an inner cap member to provide child-proofing features, as shown in FIGS. 14–16, or include only an inner and outer housing member, as shown in FIGS. 8–10 and 11–13, wherein the inner cap includes threads 55 thereon which permit attachment of the closure member 11 to the container 12.

It will be readily seen that any of the above embodiments of the present invention which include a removable indicia means such as a disc which may be mounted in a relatively fixed, stationary manner on the inner housing, may have any set of desired indicia inserted without changing the fundamental structure of the cap. Thus, one molded structure can be custom adapted to any schedule at a minimum cost. At the time the medication is placed in the bottle by a manufacturer, a pharmacist, or even a patient, a disc or other insertable and removable indicia means with the appropriate schedule for that medication may be inserted.

As shown in my previous U.S. Pat. No. 4,200,247, the abutment means including grooves and ribs may be positioned on either the inner or outer housings. It is only sufficient that the grooves and ribs eliminate play between the inner and outer housings when the abutment means are engaged, yet permit the inner and outer housings to yieldingly rotate relative to each other in one direction and are effective to stop the relative rotation of the inner and outer housings in the opposite direction, while predeterminedly controlling the positioning of the indicia disc mounted in the inner housing with respect to the opening in the outer housing to convey information to the patient and user.

It is also within the scope of the present invention to include an outer housing structure having an indicator viewing station or means which cooperates with the indicia means on the inner housing to indicate the desired indicia. For example, the outer housing may be composed of a transparent plastic material and include arrow means thereon which indicate the desired indicia. Also, it is within the scope of the present invention that the length of the side wall of the outer housing may be less than the length of the side wall of the inner housing such that the indicia on the inner housing may be exposed to cooperate with indicator viewing means on the side wall of the outer housing.

I claim:

1. A closure member for a container, including in combination:

an inner housing having means for mounting to the container, indicia means disposed in a relatively stationary manner on said inner housing and adapted to rotate with said inner housing, an outer housing rotatably mounted on and adapted to nest about said inner housing and having at least one indicator station means thereon aligned with said indicia means on said inner housing effective to pass freely the indicia thereon past said indicator station means for viewing, at least one first abutment means mounted on one of said inner or outer housings, between said inner and outer housings, and at least one second abutment means mounted to the other of said inner or outer housings opposite said one of said housings having at least one first abutment means, said second abutment means positioned to engage each of said first abutment means during rotation of said outer housing in a manner effective to stop rotation of said inner and outer housings relative to each other in one direction when said first and second abutment means are engaged, and yieldingly resist rotation of said inner and outer housings relative to each other in the opposite direction when said second abutment means is so engaged with at least one of said first abutment means, and said indicia being so disposed on said indicia means on said inner housing that said indicia are visible and aligned with said indicator station means when said first and second abutment means are engaged.

2. The closure member in accordance with claim 1 wherein said inner housing includes a top planar surface having a recess therein and said indicia means is an insertable disc member having a plurality of indicia thereon positioned and affixed in a relatively stationary manner in said recess on said top planar surface thereof.

3. The closure member in accordance with claim 2 wherein said insertable disc member is affixed in a stationary manner on said inner housing by adhesive means.

4. The closure member in accordance with claim 2 wherein said inner housing includes a projection extending upwardly, off-center from said top planar surface thereof, and said insertable disc includes an interlocking recess therethrough, positioned to engage said projection for securing said insertable disc in a stationary manner to said inner housing.

5. The closure member in accordance with claim 2 wherein said inner housing includes a projection extending upwardly from the center of said top planar surface thereof, said projection having a cross-sectional shape, and said insertable disc having a center recess therethrough having a complementary cross-sectional shape to engage said projection in a keyed manner to thereby secure said insertable disc in a stationary manner on said inner housing.

6. The closure member in accordance with claim 1 wherein said inner housing further comprises an upwardly projecting ridge therearound which provides a recess therein adapted to receive said indicia means, and a space between said inner and outer housing to prevent the relative rotation of the inner and outer housing from binding said indicia means.

7. The apparatus in accordance with claim 2 wherein said outer housing is spaced above said insertable disc member to permit rotation of said outer housing with respect to said inner housing.

8. The apparatus in accordance with claim 1 wherein said inner and outer housings each include cylindrical wall portions and said at least one first abutment means is comprised of a plurality of depressed grooves, said grooves having two walls projecting substantially radially into the cylindrical wall portion of the housing, and said at least one second abutment means is comprised of wedge-shaped ribs on said cylindrical wall of said housing in position to engage each of said depressed grooves during the rotation of said housings relative to each other.

9. The apparatus as described in claim 1 wherein said inner housing substantially conforms in shape to the shape of the opening area of the container, said indicia are disposed upon a removable indicia member, and said indicia member and said outer housing substantially conforming to the shape of the inner housing.

10. The closure member in accordance with claim 9 wherein said means for mounting to the container comprises threads and said inner housing has a portion thereof substantially conical in shape for extending over a drop dispensing means on said container; said indicia means is substantially conical in shape and is secured to said conical portion of said inner housing and said outer housing substantially conforming in shape to said inner housing and said indicia means is open-ended.

11. The closure member in accordance with claim 1 wherein said outer housing is an open-ended cylinder.

12. The closure member in accordance with claim 1 wherein said inner and outer housings have cylindrical walls and said indicia means includes a plurality of indicia removably affixed to the cylindrical walls of said inner housing by adhesive.

13. The closure member in accordance with claim 1 wherein said indicator station means is an aperture extending through said outer housing and aligned with said indicia means to cooperate therewith for indicating the predetermined indicia on said indicia means.

14. The closure member as described in claim 2 wherein said cylindrical walls of said inner and outer housing are radially spaced apart to prevent binding of said insertable disc member during the relative rotation of said inner and outer housings.

15. The closure member in accordance with claim 1 wherein said inner housing further includes an inner cap member nesting therein, said inner cap member including projecting rim means having grooves therein extending upwardly therefrom and selectively engageable with abutment means extending downwardly from said inner housing, said inner cap member further including means for mounting to the container, said inner cap member being rotatably mounted within said inner housing such that upon the downward movement and rotation of said outer housing against said inner housing, at least one of said first abutment means on said one of said inner or outer housing engages at least one of said second abutment means mounted to the other of said inner and outer housing to rotate said inner housing and selectively engage said abutment on said inner housing with said grooves on said projecting rim on said inner cap member to rotate said inner cap member to provide a twist-type child resistant closure member.

16. The closure member in accordance with claim 1 wherein said inner housing further includes a spring means extending downwardly and an inner cap member nested therein, said inner cap member comprising a top planar surface having projection means extending upwardly therefrom and means for mounting to said container, said inner cap member being rotatably mounted within said inner housing with said spring means resting upon said top planar surface of said inner cap member, such that upon the rotation of said inner housing said spring means slidably deflect past said projection means in one rotational direction and said spring means engage said projection means upon rotation of the inner housing in the opposite direction to rotate said inner cap member; said inner housing further comprising downwardly projecting teeth and said inner cap member further comprising upwardly projecting grooves spaced in an opposed manner thereon, said teeth being prevented from meshing with said grooves by the upward force exerted upon the inner housing by the spring means engaging said surface of said inner cap member, said spring means yielding to downward force upon said outer housing thereby permitting said teeth and said grooves to mesh and mutually engage permitting said inner cap member and said inner housing to be rotated in unison.

17. The closure member in accordance with claim 1 wherein said inner housing includes a cylindrical wall, an upper wall and lugs projecting inwardly from the lower portion of said inner housing cylindrical wall in a spaced manner, said means for mounting to the container comprising a resilient seal positioned within the cylindrical wall of said inner housing and extending radially outward beyond the inwardly projecting lugs, said seal projecting upwardly and selectively engageable with said upper wall of said inner housing, said lugs being engageable with the container when said resilient seal is compressed between said rim of the container and said inner housing upon the downward force on said outer housing against said inner housing to mount the closure member to the container.

18. The closure member in accordance with claim 1 wherein one of said at least one first abutment means and said at least one second abutment means are of trapezoidal-shaped structure and the other of said at least one first abutment means and said at least one second abutment means are comprised of grooves of a trapezoidal-shaped complementary design to provide cooperation between said structure and said grooves to rotate said inner and outer housings relative to each other.

19. The closure member in accordance with claim 16 wherein said downwardly projecting teeth are of trapezoidal-shaped structure and said grooves in said inner cap member are of a complementary design to provide cooperation of said teeth with said grooves to rotate said inner cap member and said inner housing in unison.

20. The apparatus in accordance with claim 1 wherein said means for mounting to said container includes a twist-type child resistant mounting means.

21. A closure for a container, said closure comprising:

an inner housing having a cylindrical wall means for sealably mounting to said container and a plurality of indicia means disposed in a relatively fixed stationary manner thereupon, a cylindrical outer housing rotatably mounted about said inner housing and having a cylindrical wall, an aperture extending therethrough aligned with said indicia effective to pass said indicia past said aperture for viewing, a plurality of depressed grooves in the cylindrical wall on one of said housings, said grooves having walls projecting radially into said housing perpendicular to the circumference of said housing, a plurality of ribs positioned on the cylindrical wall on the other of said housings, said ribs having a face substantially perpendicular to said cylindrical wall and an inclined face in position to engage each of said depressed grooves during rotation of said outer housing, said walls of said depressed grooves spaced apart and adapted to simultaneously engage both faces of said rib in a manner effective to stop rotation of said housings relative to each other in one direction when said wedge-shaped rib and depressed grooves are engaged and yieldingly resist rotation of said housings relative to each other in the opposite direction when said wedge-shaped rib is engaged in said plurality of depressed grooves, and said indicia being disposed on said inner housing such that said plurality of indicia means are visible and aligned through said aperture when said wedge-shaped rib is engaged in said plurality of depressed grooves.

22. A closure member for a container, including in combination:

an inner housing having means for mounting to the container, an outer housing rotatably mounted on and adapted to cooperatively nest about said inner housing, spring means positioned between said inner and outer housing to hold said outer housing outwardly in a relaxed position with respect to said inner housing, with said inner housing being rotatably mounted within said outer housing, at least one first abutment means mounted on one of said inner or outer housings between said inner and outer housing, at least one second abutment means mounted to the other of said inner and outer housings opposite said one of said housings having at least one first abutment means, said second abutment means positioned to engage each of said first abutment means during rotation of said outer housing in a manner effective to positively stop rotation of said inner and outer housings relative to each other in the tightening direction when said inner housing is fully tightened to the container, with said at least one first abutment means and said at least one second abutment means being prevented from cooperatively engaging together by the outward force exerted upon the outer housing by the spring means when said outer housing is rotated in the opposite direction when the said inner housing is in the tightened condition, said spring means yielding to downward force upon said outer housing thereby permitting said at least one first abutment means to engage said at least one second abutment means to rotate said inner housing in the opposite direction from the fully tightened position to provide a twist-type child resistant closure member.

23. The closure member in accordance with claim 22 wherein one of said at least one first abutment means and said at least one second abutment means are of trapezoidal-shaped structure and the other of said at least one first abutment means and said at least one second abutment means are comprised of grooves of a trapezoidal-shaped complementary design to provide cooperation between said structure and said grooves to rotate said inner and outer housings relative to each other.

* * * * *